US006068812A

United States Patent [19]

Areaux et al.

[11] Patent Number: 6,068,812

[45] Date of Patent: May 30, 2000

[54] INERT GAS BUBBLE-ACTUATED MOLTEN METAL PUMP WITH GAS-DIFFUSION GRID

[75] Inventors: Larry D. Areaux, Punta Gorda, Fla.; Anthony D. Scowden, Union, Ky.; Peter J. Corio, Fayetteville, Ark.

[73] Assignee: Premelt Pump, Inc., Kalamazoo, Mich.

[21] Appl. No.: 09/335,120

[22] Filed: Jun. 17, 1999

[51] Int. Cl.[7] ..... C21C 7/00; B67D 5/00

[52] U.S. Cl. ..... 266/217; 266/233; 266/900; 266/901; 222/603

[58] Field of Search ..... 266/217, 220, 266/233, 900, 901; 222/603

[56] References Cited

U.S. PATENT DOCUMENTS

| | | | |
|---|---|---|---|
| 5,203,910 | 4/1993 | Areaux et al. | 266/200 |
| 5,395,094 | 3/1995 | Areaux | 266/233 |
| 5,650,120 | 7/1997 | Morando | 266/233 |
| 5,735,935 | 4/1998 | Areaux | 266/901 |
| 5,984,999 | 11/1999 | Areaux | 266/900 |

*Primary Examiner*—Scott Kastler

*Attorney, Agent, or Firm*—The Firm of Gordon W. Hueschen

[57] ABSTRACT

An inert gas bubble-actuated molten metal pump, for the movement of molten metal in a molten-metal bath, which obviates the necessity of a heatproof and flameproof cover to counteract splashing and spattering at the surface of the molten metal bath above the pump, comprising an inert gas diffusion means at an upper end thereof, the diffusion means having an upper surface containing a multiplicity of small upwardly-opening apertures for the breaking up of large bubbles and the diffusion of small bubbles of inert gas upwardly therethrough. The pump includes a refractory block which comprises a conveying conduit which is preferably elongated in width and a spreader cavity in communication with both a passageway in the block for providing a source of inert gas and a lower end of the conveying conduit.

9 Claims, 3 Drawing Sheets

INERT GAS BUBBLE-ACTUATED MOLTEN METAL PUMP WITH GAS-DIFFUSION GRID

BACKGROUND OF THE INVENTION

1. Field of the Invention

The field of the invention is inert gas bubble-actuated molten metal pumps for use in a well of a metal-melting furnace and in particular relates to an improved inert gas bubble-actuated molten metal pump incorporating a gas-diffusion grid for purposes of obviating certain disadvantages of known such pumps as well as certain other novel and advantageous characteristics, all of which will become apparent hereinafter.

2. Prior Art

The state of the art regarding the introduction of metal chips into a charge or other well of a metal-melting furnace and the conveyance of molten metal from one place to another within or out of a metal-melting furnace has been fully reviewed in the prior U.S. patents of one of us, in particular U.S. Pat. No. 5,735,935, issued Apr. 7, 1998, and the disclosure of that patent as well as of those enumerated therein is hereby incorporated by reference.

At the present state of the art, the use of an inert gas bubble-actuated molten metal pump for moving molten metal from one place to another within or out of a metalmelting furnace is now well established. The term "actuated", with reference to an inert gas bubble "actuated" molten metal pump, means that the pump is put into action by the inert gas bubbles or, synonymously, that the pump could be said to be driven, propelled, or powered by the inert gas bubbles.

Although the inert gas bubble-actuated molten metal pump of the previous U.S. Pat. No. 5,203,910 and others of one of us has met with considerable success, when such device has been employed within a metal-melting furnace to move molten metal from one place to another in the same well of the metal-melting furnace or from one well to another in a metal-melting furnace, for purposes of effecting circulation of the molten metal therein, and is a great improvement over previously-employed circulation pumps, several undesirable effects have been noted. In particular, undue spattering or splashing of molten metal at the surface of the molten metal mass above the exit port of the pump has been found objectionable per se, in addition to the fact that the splashing and spattering have caused a disruption of the protective metal oxide coating or dross which generally accumulates at the surface of the molten metal bath or pool, with the result that increased levels of oxidation, which would normally not be encountered, have occurred at the surface of the molten metal mass, and the solution to these problems has frequently required the presence of a heat-resistant and flame-resistant cover above the exit port of the bubble-actuated molten metal pump to reduce the resultant splashing and spattering at the surface of the molten metal bath or pool, as provided in the earlier U.S. Pat. No. 5,735,935 of one of us.

It would be highly desirable to eliminate the necessity of such a heat- and flame-resistant cover while at the same time avoiding the undesirable spattering or splashing of molten metal at the surface of the molten metal mass, bath, or pool above the exit port of the pump, and the present invention provides a solution to the aforesaid problems as well as providing additional advantages due to the unique details of construction of the bubble-actuated molten metal pump of the present invention.

OBJECTS OF THE INVENTION

It is an object of the present invention to eliminate the undesirable splashing and spattering at the surface of a molten metal mass, bath, or pool, by the provision of a unique bubble-actuated molten metal pump having a built-in gas-diffusion grid at the upper and exit end thereof. It is a further object of the invention to provide such a bubble-actuated molten metal pump having particular details of construction which enable the production and passage of relatively large inert gas bubbles through the conveying conduit thereof, as well as structure for the production of such relatively large inert gas bubbles within the molten metal pump itself from a single point of introduction of the inert gas employed in its operation, but which large gas bubbles are broken up into a multiplicity of small bubbles by the gas diffusion means of the invention. Still other objects of the invention will become apparent hereinafter and yet other objects will be apparent to one skilled in the art to which this invention pertains.

SUMMARY OF THE INVENTION

What we believe to be our invention, then, inter alia, comprises the following, singly or in combination:

An inert gas bubble-actuated molten metal pump, for the movement of molten metal in a molten metal bath, which obviates the necessity of a heatproof and flame-proof cover to counteract splashing and spattering at the surface of the molten metal bath above the pump, comprising:

a block of molten metal- and high temperature- resistant refractory material adapted to be placed into communication with a source of inert gas and into a molten metal bath for movement of the molten metal therein by means of inert gas bubbles, an inert gas-feed passageway in said block for the passage of inert gas from a source thereof to an exit from said passageway, a conveying conduit in said block and in communication with said gas-feed passageway exit, the exit of said gasfeed passageway communicating with a lower end of said conveying conduit for the conveyance of molten metal and inert gas bubbles therein and therethrough when said block is in place in a molten-metal bath, said conveying conduit having also an upper end, an inert gas diffusion means at an upper end of said block and in communication with the upper end of said conveying conduit, said diffusion means having an upper surface containing a grid comprising a multiplicity of small upwardly-opening apertures for the breaking up of large bubbles and the diffusion of small bubbles of inert gas upwardly therethrough; such a pump wherein the refractory material is a graphite, ceramic, silica, or silicon carbide material; such a pump wherein the refractory material is graphite; such a pump wherein the grid in the upper surface of said diffusion means comprises apertures of approximately one-eighth to three-eighths inch in diameter; and such a pump wherein the number of apertures is in excess of 100.

Moreover, such a pump wherein the conveying conduit is elongated in width and wherein a spreader cavity is provided in said block in communication with both the gas-feed passageway exit and a lower end of said conveying conduit, as well as such a pump comprising, on an upper surface of said block, apertures for the insertion and securement of refractory support columns therein for mounting of the pump in a molten metal bath; such a pump wherein an inert gas feed line is located within a refractory support column, and finally such a pump wherein said apertures in said block for said support columns are threaded.

DESCRIPTION OF THE DRAWINGS

Reference is now made to the drawings, wherein.

DETAILED DESCRIPTION OF THE INVENTION

Figure 1:
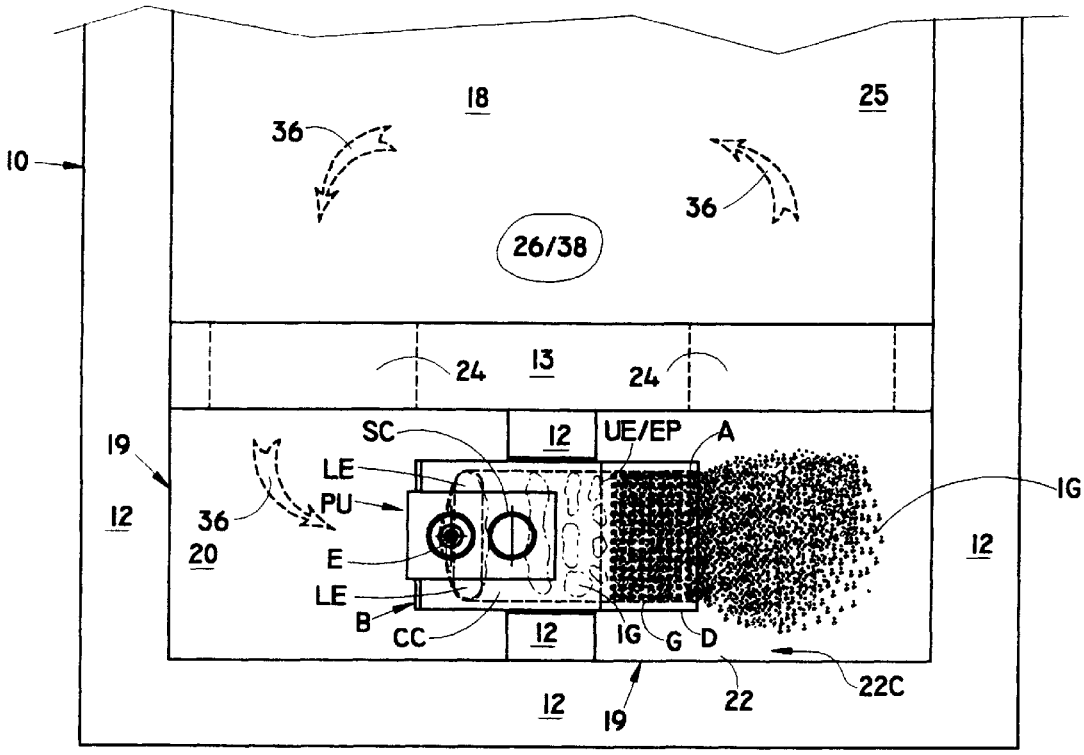
FIG. 1 is a top plan view of a metal-melting furnace, in this case a reverberatory furnace, partially schematic and partially in section, taken along line 1—1 of FIG. 2, to show the apparatus of the present invention and to illustrate its use, including especially the various chambers or wells of a usual metal-melting furnace, and the inert gas bubble-actuated molten metal pump in a well of the furnace, as shown between adjacent wells, having its inlet port in one well and its exit port in another.
Figure 2:
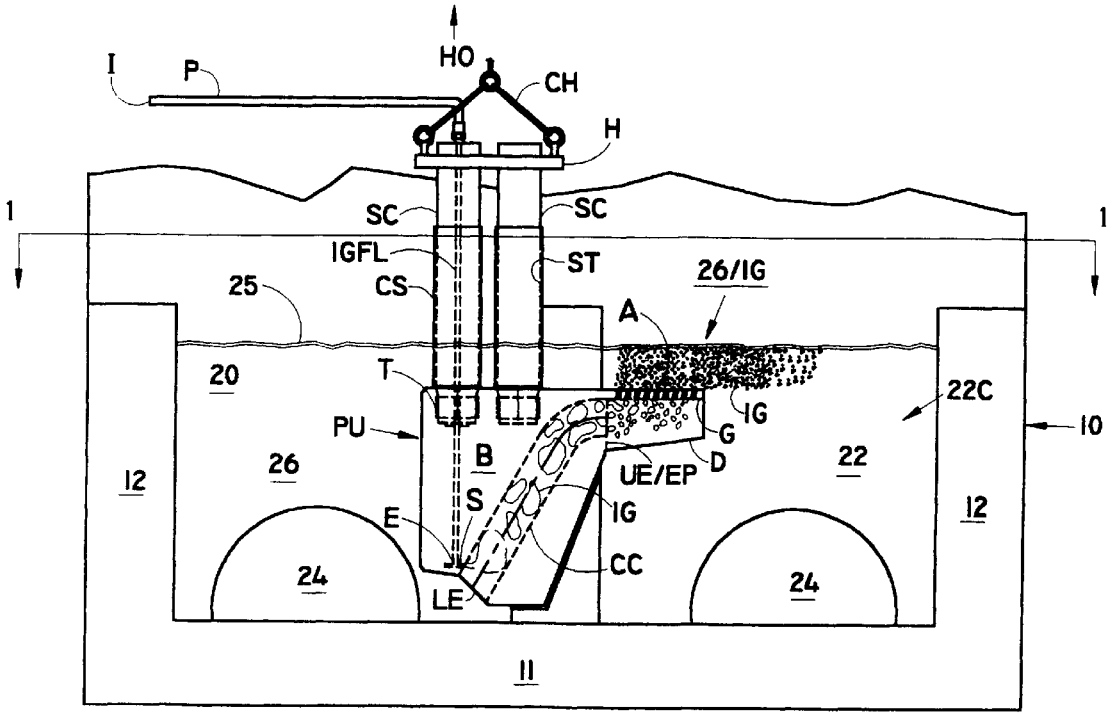
FIG. 2 is a front elevational view, partially schematic and partially in section, showing the apparatus of the invention illustrating its use in association with a well or wells of the reverberatory furnace, the inert gas bubble-actuated molten metal pump, its location in a wall between adjacent chambers or wells, and in particular its inert gas diffusion grid means at the upper end or exit port thereof.
Figure 3:
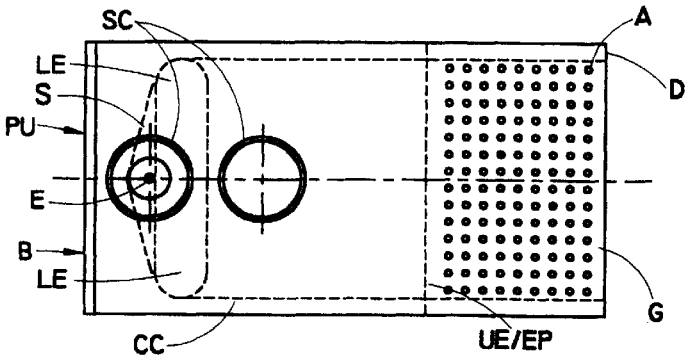
FIG. 3 is a top plan view of the inert gas bubble-actuated molten metal pump of the invention including its integral inert gas diffusion grid.
Figure 4:
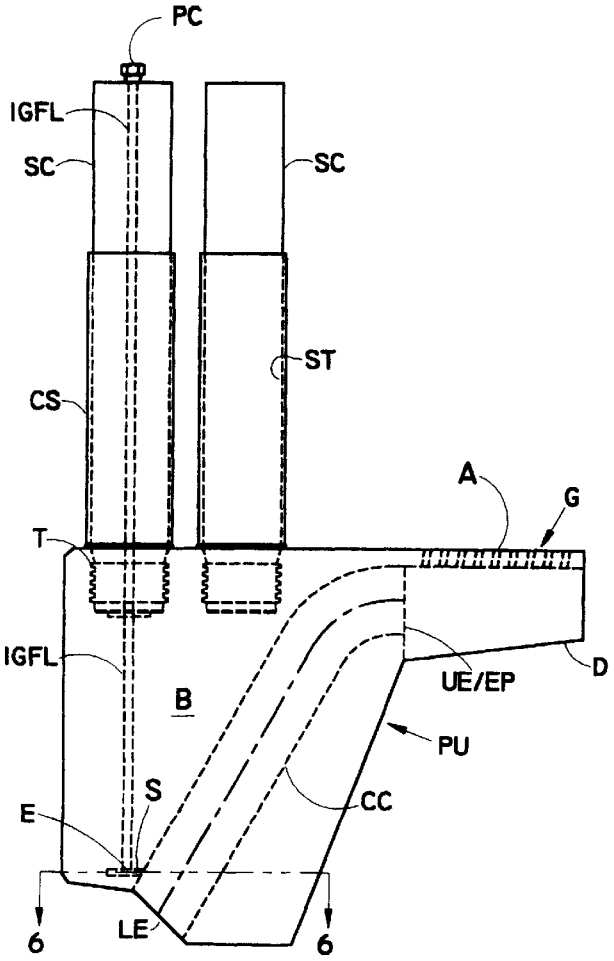
FIG. 4 is a side elevation of the bubble-actuated molten metal pump of the invention including its integral inert gas-diffusion grid.
Figure 5:
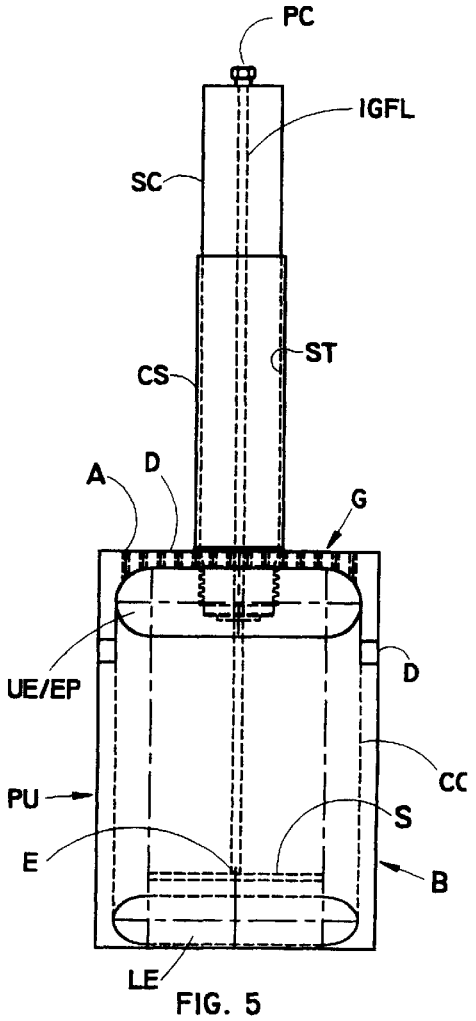
FIG. 5 is an end elevation of the inert gas bubble-actuated molten metal pump of the invention including its unique inert gas-diffusion grid.
Figure 6:
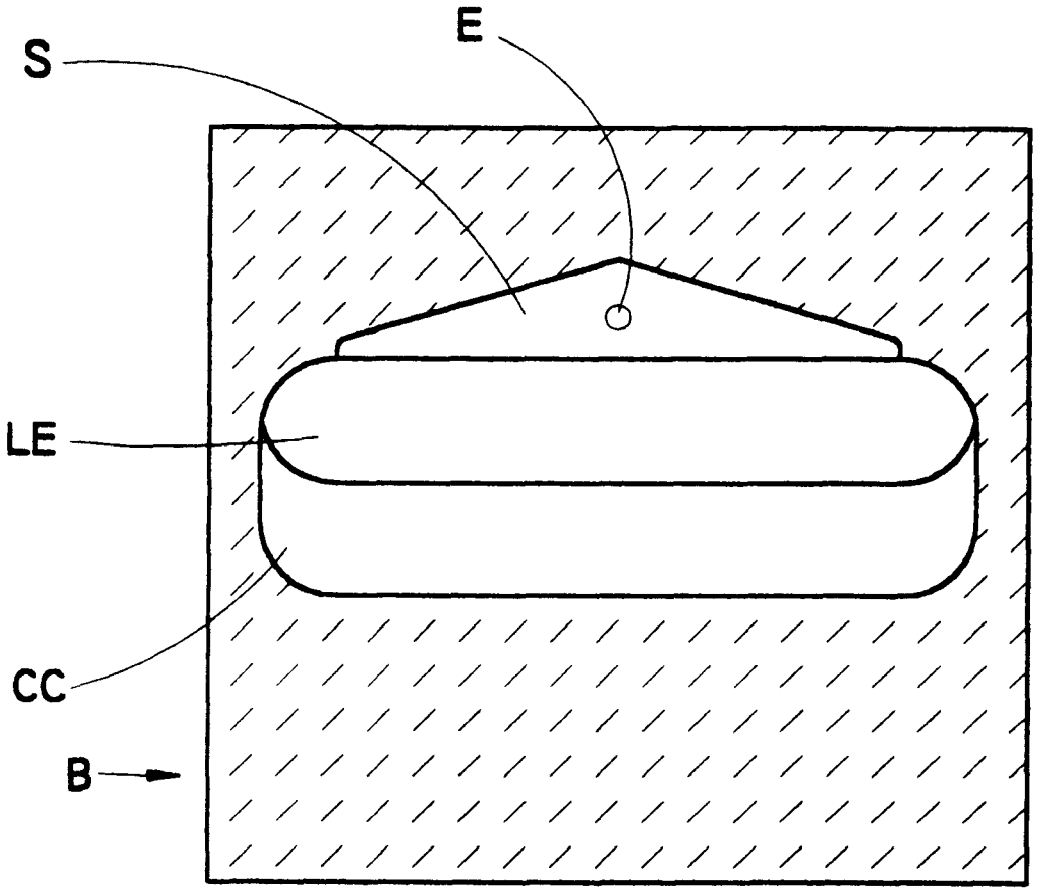
FIG. 6 is a section taken along the line 6—6 of FIG. 4, showing the single inert gas feed line exit and the spreader cavity for transporting the gas from the feed line exit into the lower end of the widthwise elongated oblong or oval cross-section conveying conduit of the pump according to the present invention.

The present invention will be more readily understood from the following detailed description, particularly when taken in conjunction with the drawings, in which all of the significant parts are numbered or lettered and wherein the same letters and numbers are used to identify the same parts throughout.

A metal-melting furnace, as shown a reverberatory furnace, of refractory material or having the usual refractory lining and fired by combustion burners fed by natural gas or fuel oil, which throw flames into the interior of main chamber 18 thereof through usual flame-introduction means, is shown in the FIGS. at 10. The furnace well comprises bottom wall 11 and side or vertical walls 12 and 13, with a mass of molten metal, preferably and usually aluminum or magnesium or an alloy thereof, therein being shown at 26. The base portion 11 of the furnace may be supported on the underlying floor by means of I-beam supports, not shown. Main chamber 18 is provided with main chamber extensions 19 in the form of intermediate well 20, usually referred to as the circulation well, and adjacent well 22, which is usually but in this case need not be the charge well, connected with each other and with main chamber 18 by means of communicating passageways 24.

Molten metal 26 is contained in main chamber 18 and is circulated from the hottest part thereof, indicated at 38, through intermediate well 20 into adjacent well 22 via communicating passageway 24. The necessary circulation throughout the furnace is provided by means of inert gas bubble-actuated molten metal pump PU, located in an opening in wall 12 between intermediate well 20 and adjacent well 22. Separate circulating means in what is normally circu lation well 20 is not required.

Conveying conduit CC of pump PU is molded in or routed out of a block of refractory material B, which is resistant to the molten metal 26 and the high temperature employed, the refractory material usually being of a graphite, ceramic, silica, or silicon carbide material. As shown, it is of graphite. Elongated conveying conduit CC is angled with an upper portion extending to the horizontal and a lower portion extending downwardly at an angle to the horizontal, the lower end thereof being designated LE and the upper end thereof being designated UE. The angle to the horizontal of the upper portion of conduit CC is a definitely preferred aspect or embodiment of the invention for attainment of the stated objectives, with the upper end UE also sometimes being referred to herein as the exit port EP of pump PU and conduit CC. The upper end UE of conduit CC and of the pump PU discharges into an extension D of the pump PU, made of the same refractory material B as the rest of the pump, the extension D constituting a gas-dispersion or gas-diffusion means having a plurality of apertures A in its upper surface, to cause the larger inert gas bubbles to break up into a multiplicity of smaller bubbles which then escape upwardly through the grid G thereof in a controlled manner which does not induce spattering or splashing of the molten metal at the surface thereof. Extension D may have top and side walls only, or may include a bottom, in which case it is tubular in nature.

Also visible in the drawings are the surface of the molten metal mass with its usual layer of metal oxide or dross 25, which ordinarily collects at the surface of the molten metal pool or bath or mass 26, this being shown as present in all of the wells of the metal melting furnace 10. According to the usual flow path or pattern 36 in such a metal-melting furnace, as created by the action of the inert gas bubble-actuated molten metal pump PU and the conveying conduit CC thereof, circulation of molten metal 26 in furnace main chamber 18 is constantly and continuously moved from the hottest point 38 thereof in main chamber 18 through communicating passageways 24 into intermediate well 20 and then into adjacent well 22.

When and if well 22 is used as a charge well of the furnace for introduction of metal chips into cavity 22C thereof, a chip-charger means will be employed in conjunction therewith, but this is immaterial according to the present invention.

As is usual the flow of molten metal 26 in the pump PU is effected by means of bubbles of inert gas IG introduced into the conveying conduit CC at or adjacent its lower end LE and rising up the incline therein to emerge at the upper end or exit port UE/EP, at which point the molten metal 26 and the inert gas IG, together referred to as effluent 26/IG, moves out into well 22, the outlet or upper end UE and exit port EP of the conveying conduit CC, and thus of the pump PU, being directed into well 22 and the mass of molten metal 26 therein. However, instead of "shooting out" into the mass of molten metal 26 in well 22, as is usually the case, the larger bubbles of inert gas IG are broken up into many smaller bubbles as they pass into and through diffuser D and the apertures A in the grid G in the upper surface thereof, and the propellant gas is thus dissipated without splattering or splashing at the surface of the molten metal mass 26 in well cavity 22C and frequently even without disruption of the protective layer or skin of molten metal oxide or dross 25 at the surface thereof. Grid C may advantageously comprise 126 apertures, each of ⅜ inch diameter, and each preferably at an approximately 10 degree angle with the vertical, this grid comprising a substantial portion of the upper surface of gas-diffuser or gas-dispersion means D.

The lower end of the inert-gas supply or feed line IGFL in the form of a gas-feed passageway provided in block B and in one support column SC, in turn connected to pipe P at pipe connector PC, provides a single outlet or exit port E for the inert gas, which then expands and passes through spreader cavity S whereafter it is released into the lower end LE of conveying conduit CC, in this case having internal dimensions which provide a substantially greater width than height to the conduit CC. The spreader cavity S, together with the widthwise elongated ovoid or oblong-shaped conduit CC, permits the formation of much larger and, for moving of molten metal, more efficient, inert gas bubbles than would be possible without the spreader cavity S and with a conduit CC having a circular configuration or other configurations having internal dimensions wherein the width thereof does not substantially exceed the height thereof. However, the larger size of these more efficient bubbles makes it all the more necessary to break them up into a multiplicity of small bubbles by means of the gas-diffuser or gas-dispersion means D.

As shown in the drawings, the gas feed means comprises inlet port I and pipe P, in communication through PC with inert-gas feed line IGFL in the form of a passageway having an exit port E at its lower end, which in turn communicates with the lower end LE of the widthwise elongated conveying conduit CC of pump PU through spreader cavity S, the said passageway or IGFL being provided in a support column SC and in supporting block B, both of refractory material, which block B is also attached to support columns SC, the connections between support columns SC and block B involving threads T on support columns SC which engage with cooperating threads T in apertures in block B. Support columns SC are supported from hanger H, in turn supported by chain or cable CH connections to a ring or hook, in turn suitably connected to a hoist HO, not shown, for convenient introduction and removal of pump PU and its auxiliary fittings, supports, and inert gas feed line as a unit into and from their operative location in a well or wells of the metal-melting furnace. Support columns SC may advantageously be clad with or surrounded by ceramic sleeves CS, which may in turn be cemented to the support columns SC by means of sealant ST, advantageously a high-temperature graphite mortar, which may also conveniently and advantageously be employed to seal the joints between the support columns and the block B above threads T and where support columns SC abut block B and/or enter threaded apertures therein. Alternatively, the support columns SC may advantageously be flame-sprayed with ceramic prior to encasing them with ceramic sleeves CS as just described.

OPERATION

In operation, molten metal from main chamber 18 of the metal-melting furnace 10 is circulated throughout the furnace with the assistance of inert gas bubble-actuated molten metal pump PU, the pump operating within the furnace in the manner of previous inert gas bubble-actuated molten metal pumps in accord with the disclosure of the previous U.S. Pat. No. 5,735,935 of one of us and other patents cited therein. The advantage of employing the pump of the present invention is the absence of splashing or spattering at the surface of the molten metal above the outlet end of the pump, because of the multiplicity of apertures A in the grid G of integral diffuser D. As a further advantage of the pump of the present invention, the provision of a single inert gas outlet, communicating with a spreader cavity, and thence with the widthwise elongated conveying conduit of the pump of the present invention, permits the more efficient molten-metal pumping utilization of the gas in the form of relatively larger gas bubbles without the necessity of a plurality of points of introduction of the inert gas into the pump and the conveying conduit thereof and accordingly increases the efficiency of the operation in this respect as well. In addition, upon exiting the metal-moving pump together with metal being moved by the same, the inert gas passes into the diffuser at the upper end thereof and is directed upwardly through the apertures in the grid located in the upper surface thereof, thereby converting large bubbles into a multiplicity of tiny bubbles and thereby avoiding the inconvenience of spattering or splashing of the molten metal at the upper surface thereof and sometimes even without disruption of the protective layer of metal oxide or dross at the said surface, thus presenting an overall highly efficient and yet highly economic and advantageous arrangement of apparatus for the circulation of molten metal throughout the various chambers of a metal-melting furnace.

IN GENERAL

The bubble-actuated molten metal pump of the invention as well as the gas feed means of the invention are generally constructed of or arranged so as to expose only high-temperature molten metal-resistant ceramic, graphite, silica, or silicon carbide or the like, and the hangers and support columns supporting the same within the metal mass may be bonded thereto as by welding, clamping, or ceramic or adhesive bonding around the exterior thereof or in some cases may be molded into the ceramic, graphite, silica, or silicon carbide material of construction, or in other cases may even be of mild or stainless or such steel coated or plated with a refractory material. Of course, it goes without saying that the structure and material of construction, as particularly described under "DETAILED DESCRIPTION OF THE INVENTION" herein, is preferred.

The metal of the metal mass, pool, or bath, whenever referred to herein, may be of any suitable material of the type usually employed or found in a metal-melting furnace, including aluminum, magnesium, titanium, brass, iron, or steel, or an alloy thereof, or a metal for alloying one of said metals, and in most common practice today is aluminum or an alloy thereof. The molten metal may be new or previously used, including even and especially new and used aluminum sheet and can scrap, as is now conventional in the art.

It is thereby seen from the foregoing that the objects of the present invention have been accomplished and that a novel, efficient, and economic apparatus has been provided, all accord with the OBJECTS OF THE INVENTION and the SUMMARY OF THE INVENTION as set forth hereinbefore.

It is to be understood that the present invention is not to be limited to the exact details of operation, or to the exact compounds, compositions, methods, procedures, or embodiments shown and described, as various modifications and equivalents will be apparent to one skilled in the art, wherefore the present invention is to be limited only by the full scope which can be legally accorded to the appended claims.

We claim:

1. An inert gas bubble-actuated molten metal pump, for the movement of molten metal in a molten metal bath, which obviates the necessity of a heatproof and flameproof cover to counteract splashing and spattering at the surface of the molten metal bath above the pump, comprising:

a block of molten metal- and high temperature-resistant refractory material adapted to be placed into communication with a source of inert gas and into a molten metal bath for movement of the molten metal therein by means of inert gas bubbles, an inert gas-feed passageway in said block for the passage of inert gas from a source thereof to an exit from said passageway, a conveying conduit in said block and in communication with said gas-feed passageway exit, the exit of said gasfeed passageway communicating with a lower end of said conveying conduit for the conveyance of molten metal and inert gas bubbles therein and therethrough when said block is in place in a molten metal bath, said conveying conduit having also an upper end, an inert gas diffusion means at an upper end of said block and in communication with the upper end of said conveying conduit, said diffusion means having an upper surface containing a grid comprising a multiplicity of small upwardly-opening apertures for the breaking up of large bubbles and the diffusion of small bubbles of inert gas upwardly therethrough.

2. A pump of claim 1, wherein the refractory material is a graphite, ceramic, silica, or silicon carbide material.

3. A pump of claim 2, wherein the refractory material is graphite.

4. A pump of claim 1, wherein the grid in the upper surface of said diffusion means comprises apertures of approximately one-eighth to three-eighths inch in diameter.

5. A pump of claim 4, wherein the number of apertures is in excess of 100.

6. A pump of claim 1, wherein the conveying conduit is elongated in width and wherein a spreader cavity is provided in said block in communication with both the gas-feed passageway exit and a lower end of said conveying conduit.

7. A pump of claim 1 comprising, on an upper surface of said block, apertures for the insertion and securement of support columns therein for mounting of the pump in a molten metal bath.

8. A pump of claim 7 wherein an inert gas feed line is located within a refractory support column.

9. A pump of claim 7, wherein said apertures in said block for said support columns are threaded.

* * * * *